US010407987B2

(12) United States Patent
Downton et al.

(10) Patent No.: US 10,407,987 B2
(45) Date of Patent: Sep. 10, 2019

(54) PROGRESSIVE CAVITY BASED CONTROL SYSTEM

(71) Applicant: Schlumberger Technology Corporation, Sugar Land, TX (US)

(72) Inventors: Geoffrey C. Downton, Stroud (GB); Maxim Pushkarev, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 417 days.

(21) Appl. No.: 14/653,756

(22) PCT Filed: Dec. 16, 2013

(86) PCT No.: PCT/US2013/075401

§ 371 (c)(1),
(2) Date: Jun. 18, 2015

(87) PCT Pub. No.: WO2014/099789

PCT Pub. Date: Jun. 26, 2014

(65) Prior Publication Data

US 2015/0354280 A1 Dec. 10, 2015

Related U.S. Application Data

(60) Provisional application No. 61/739,624, filed on Dec. 19, 2012.

(51) Int. Cl.
*E21B 4/00* (2006.01)
*E21B 4/02* (2006.01)
(Continued)

(52) U.S. Cl.
CPC ..... *E21B 4/02* (2013.01); *E21B 4/003* (2013.01); *E21B 43/126* (2013.01); *F01C 1/101* (2013.01);
(Continued)

(58) Field of Classification Search
CPC ..... E21B 4/00; E21B 4/02; E21B 4/03; E21B 43/126; F01C 1/101; F01C 21/02;
(Continued)

(56) References Cited

U.S. PATENT DOCUMENTS 2,505,136 A 4/1950 Louis et al.
3,938,915 A 2/1976 Olofsson
(Continued)

FOREIGN PATENT DOCUMENTS

EP 2113667 A1 11/2009
EP 2407667 A1 1/2012
(Continued)

OTHER PUBLICATIONS

Office Action issued in related RU application 2015128854 dated Jul. 7, 2016, 10 pages.
(Continued)

*Primary Examiner* — David J Bagnell
*Assistant Examiner* — Dany E Akakpo

(57) ABSTRACT

A technique facilitates control over the actuation of a device by utilizing a rotor and a corresponding stator system. The technique employs a rotor and a corresponding stator component in a progressive cavity type system. The rotor and corresponding stator component are mounted such that rotational and/or axial motion may be imparted to at least one of the rotor or stator components relative to the other component. The controlled rotation may be utilized in providing controlled motion of an actuated device via the power of fluid moving through the progressive cavity type system.

21 Claims, 11 Drawing Sheets

(51) Int. Cl.

| | |
|---|---|
| ***F03B 13/02*** | (2006.01) |
| ***E21B 43/12*** | (2006.01) |
| ***F01C 1/10*** | (2006.01) |
| ***F01C 21/00*** | (2006.01) |
| ***F01C 21/02*** | (2006.01) |
| ***F04C 2/107*** | (2006.01) |

(52) U.S. Cl.
CPC ..... *F01C 21/008* (2013.01); *F01C 21/02* (2013.01); *F03B 13/02* (2013.01); *F04C 2/1075* (2013.01); *F04C 2240/811* (2013.01)

(58) Field of Classification Search
CPC ..... F01C 21/008; F04C 2/1075; F04C 2240/811; F04D 13/0626; F04D 13/0673; F04D 13/08; F04D 13/10; F04D 25/0613; F04D 25/0646; F04D 25/0686
See application file for complete search history.

(56) References Cited

U.S. PATENT DOCUMENTS

| | | | | |
|---|---|---|---|---|
| 4,011,917 | A | 3/1977 | Tiraspolsky et al. | |
| 5,265,682 | A * | 11/1993 | Russell | E21B 4/02 175/45 |
| 6,109,372 | A | 8/2000 | Dorel et al. | |
| 6,457,958 | B1 * | 10/2002 | Dunn | F04C 2/1071 418/1 |
| 6,837,315 | B2 | 1/2005 | Pisoni et al. | |
| 7,383,898 | B2 | 6/2008 | Downton | |
| 7,987,927 | B2 | 8/2011 | Downton | |
| 8,011,452 | B2 | 9/2011 | Downton | |
| 8,776,896 | B2 * | 7/2014 | Konschuh | E21B 34/066 166/373 |
| 2002/0074167 | A1 | 6/2002 | Plop | |
| 2003/0056990 | A1 * | 3/2003 | Oglesby | E21B 4/003 175/57 |
| 2003/0127252 | A1 | 7/2003 | Downton | |
| 2004/0011520 | A1 * | 1/2004 | McGarian | E21B 23/04 166/117.7 |
| 2004/0089480 | A1 | 5/2004 | Dewey | |
| 2005/0109542 | A1 | 5/2005 | Downton | |
| 2006/0216178 | A1 | 9/2006 | Sindt et al. | |
| 2006/0237234 | A1 | 10/2006 | Dennis et al. | |
| 2006/0243492 | A1 | 11/2006 | Downton | |
| 2007/0151767 | A1 | 7/2007 | Downton | |
| 2009/0139225 | A1 | 6/2009 | Wang et al. | |
| 2009/0169364 | A1 | 7/2009 | Downton | |
| 2010/0126774 | A1 | 5/2010 | Downton | |
| 2010/0187009 | A1 | 7/2010 | Siher et al. | |
| 2011/0042144 | A1 | 2/2011 | Downton | |
| 2011/0056695 | A1 | 3/2011 | Downton | |
| 2011/0120725 | A1 | 5/2011 | Downton et al. | |
| 2011/0214963 | A1 * | 9/2011 | Beylotte | E21B 4/02 192/106 R |
| 2011/0266063 | A1 | 11/2011 | Downton | |
| 2015/0075871 | A1 * | 3/2015 | Strittmatter | E21B 4/006 175/106 |

FOREIGN PATENT DOCUMENTS

| | | | |
|---|---|---|---|
| GB | 2408526 | A | 6/2005 |
| GB | 2418456 | A | 3/2006 |
| GB | 2433082 | A | 6/2007 |
| GB | 2439661 | A | 1/2008 |
| GB | 2454880 | A | 5/2009 |
| RU | 250803 | | 8/1969 |
| RU | 2164999 | C2 | 4/2001 |
| RU | 2235861 | C2 | 3/2004 |
| RU | 2299966 | C2 | 2/2007 |
| SU | 945340 | A | 7/1982 |
| WO | 2004113664 | A1 | 12/2004 |
| WO | 2009067468 | A1 | 5/2009 |
| WO | 2009085753 | A2 | 7/2009 |
| WO | 2009085753 | A3 | 9/2009 |
| WO | 2010061168 | A2 | 6/2010 |
| WO | 2009085753 | A8 | 9/2010 |
| WO | 2010061168 | A3 | 10/2010 |
| WO | 2011030095 | A2 | 3/2011 |
| WO | 2014099789 | A1 | 6/2014 |
| WO | WO2014099783 | A1 | 6/2014 |

OTHER PUBLICATIONS

First Office Action issued in related CN application 201380070850.2 dated Jul. 6, 2016, 16 pages.
International Search Report and Written opinion issued in related PCT application PCT/US2013/075401 dated Apr. 18, 2014, 11 pages.
International Search Report for International Application No. PCT/US2013/075401 dated Apr. 18, 2014.
International Preliminary Report on Patentability issued in International Patent application PCT/US2013/075401, dated Jun. 23, 2015. 7 pages.
Second Office Action and Search Report issued in related CN application 201380070850.2 dated Mar. 2, 2017, 15 pages.
Search Report Rule 62 EPC and Examination Report Issued in European Patent Application 13865499.1 dated Oct. 26, 2016. 8 pages.
Decision on Grant issued in Russian Patent Application 2015128854 dated Dec. 28, 2016, 4 pages.

* cited by examiner

PROGRESSIVE CAVITY BASED CONTROL SYSTEM

BACKGROUND

Hydrocarbon fluids such as oil and natural gas are obtained from a subterranean geologic formation, referred to as a reservoir. In a variety of well operations, mud motors are used to convert flowing mud into rotary motion. The rotary motion can be used to drive a drill bit during a drilling operation. Mud motors generally are designed as Moineau motors, i.e. progressive cavity motors, which employ a helical rotor within a corresponding stator. The helical rotor is rotated by fluid flow through the mud motor between the helical rotor and the corresponding stator.

SUMMARY

In general, the present disclosure provides a system and method for controlling actuation of a device by utilizing a rotor and a corresponding stator component in a progressive cavity type system. The rotor and corresponding stator component are mounted such that rotational and/or axial motion may be imparted to at least one of the rotor or stator components relative to the other component. The controlled rotation may be utilized in providing controlled motion of an actuated device via the power of fluid moving through the progressive cavity type system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
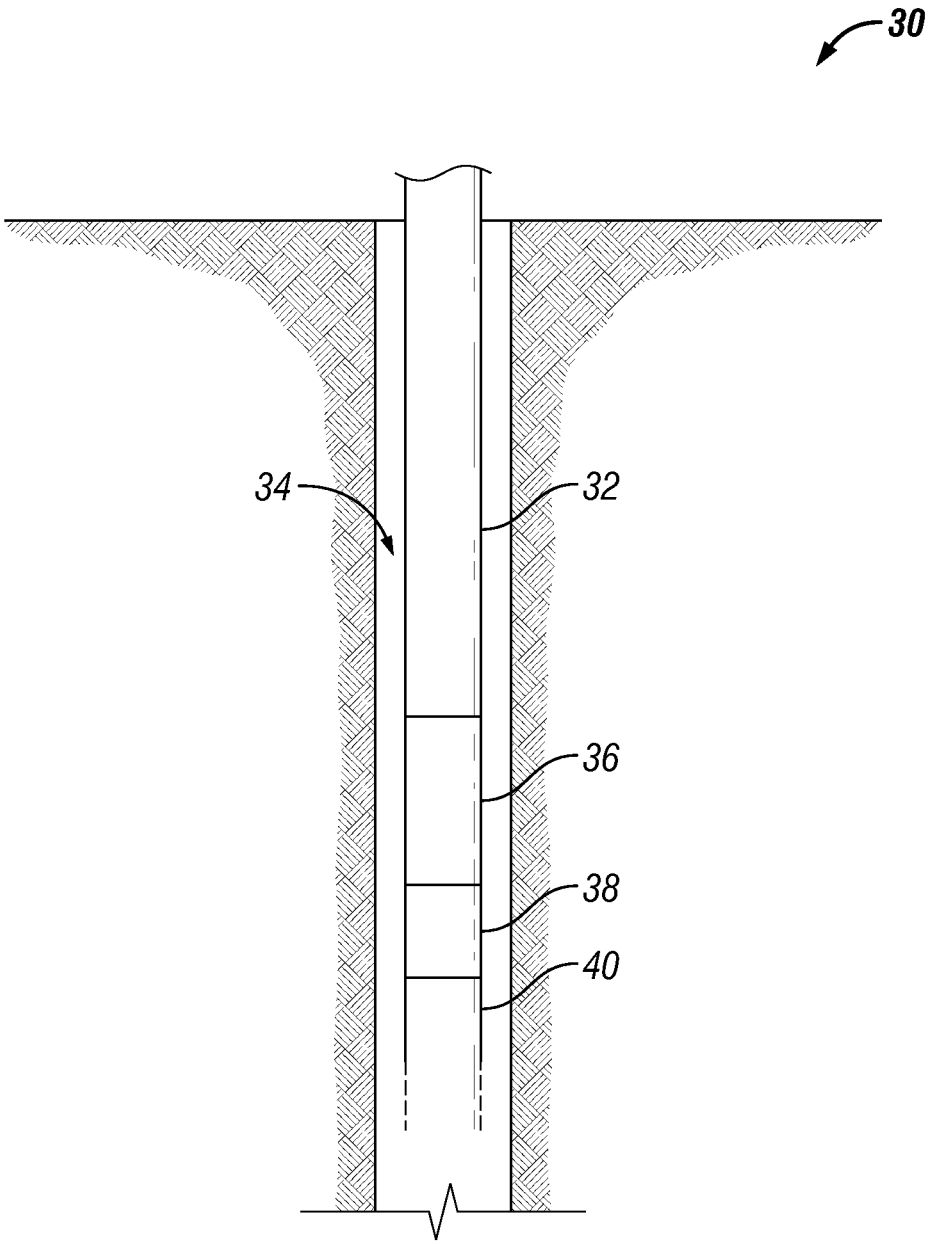
FIG. 1 is a wellsite system in which embodiments of an actuation control system can be employed to control the actuation of an actuatable device, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to controlling desired motion of an actuatable device by employing a progressive cavity assembly. By way of example, the progressive cavity assembly may be in the form of a Moineau assembly utilizing a rotor and a corresponding stator system. The rotor is mounted for cooperation with the stator system. For example, a rotor, a stator component, or both may be mounted for relative rotation which is correlated with the volumetric displacement of the fluid passing between the rotor and the stator component. In embodiments of the disclosure, a progressive cavity motor may be operated by fluid flowed through the progressive cavity motor; and a progressive cavity pump may be operated to cause fluid flow through the progressive cavity pump. A control system is employed to control the angular displacement and/or torque of the rotor and/or stator component.

The control system enables use of the assembly in a wide variety of applications that may utilize a more precise control over angular displacement and/or torque applied to an actuatable device. In some applications, the control system operates in cooperation with a mud motor to form an overall, servo type actuation control system. The overall actuation control system may be used to control the speed and angle of rotation of an output shaft. In many applications, the overall actuation control system may be employed as a high fidelity rotary servo capable of achieving precision angular positioning, angular velocity, and torque output control. In some wellbore drilling operations, the actuation control provided by the mud motor of the overall actuation control system may be combined with the rig pump control system.

Additionally, the progressive cavity system and corresponding control system may be used to introduce controlled freedom of motion of a stator component with respect to a corresponding collar. In some applications, the rotor is constrained by holding a central axis of the rotor to a fixed position while a corresponding stator can is rotated via fluid flow through the progressive cavity system. Some embodiments also may utilize a stator can which is slidable and controlled in a longitudinal direction to provide a different or an additional degree of freedom for controlling an actuatable device. By constraining the rotor and rotating the stator can, the progressive cavity system may be used as a high-speed motor or other rotational device for driving the associated actuatable device. In other embodiments, the progressive cavity type control system is constructed as a two speed motor.

Referring to FIG. 1, an example is illustrated in which an actuation control system is employed in a well operation to control actuation of a well component. However, the actuation control system may be employed in a variety of systems and applications (which are well related or non-well related) to provide control over angular positioning, angular velocity, and/or torque output. The control provided with respect to these characteristics enables use of the actuation control system for actuating/controlling a variety of devices.

In the example illustrated in FIG. 1, a well system 30 is illustrated as comprising a well string 32, such as a drill string, deployed in a wellbore 34. The well string 32 may comprise an operational system 36 designed to perform a desired drilling operation, service operation, production operation, and/or other well related operation. In a drilling application, for example, the operational system 36 may comprise a bottom hole assembly with a steerable drilling system. The operational system 36 also comprises an actuation control system 38 operatively coupled with an actuatable device 40. As described in greater detail below, the actuation control system 38 employs a progressive cavity system, e.g. a mud motor or mud pump system, to provide a predetermined control over actuatable component 40.

In drilling applications, the actuatable device 40 may comprise a drill bit having its angular velocity and/or torque output controlled by the actuation control system 38. However, the actuation control system 38 may be used in a variety of systems and applications with a variety of actuatable devices 40. By way of example, the actuation control system 38 may be used as a high-speed motor. In some applications, the actuation control system 38 may be constructed as a two speed motor or a steerable motor. The actuation control system 38 also may be constructed as a precision orienter to control the tool-face of actuatable device 40 in the form of, for example, a bent housing mud motor. In some applications, the actuation control system 38 may be connected to a measurement-while-drilling system and/or a logging-while-drilling system. In some embodiments, the actuation control system 38 also may be designed with an axial control capability.

In various well related applications, system 38 and device 40 may comprise a mud motor powered bit-shaft servo for controlling a steering system. In another application, the actuation control system 38 may comprise a mud motor employed to power a mud-pulse telemetry siren. Another example utilizes the mud motor of system 38 as a servoed eccentric offset for a "powered" non-rotating stabilizer rotary steerable system such as the steering systems described in U.S. Pat. Nos. 6,109,372 and 6,837,315. The actuation control system 38 also may be used to achieve a high level of RPM and torque control over a drill bit for desired rock-bit interaction.

In other applications, the actuation control system 38 may be utilized as an active rotary coupling to isolate actuatable device 40, e.g. to isolate a bottom hole assembly from drill-string transients while still transmitting torque. The progressive cavity system of actuation control system 38 also may be employed as a precision downhole pump for managed pressure drilling and equivalent circulating density control. The system 38 also may comprise a precision axial thruster in which the servoed mud motor drives a lead screw to control actuatable device 40 in the form of a thruster. Similarly, the mud motor of actuation control system 38 may be employed as a power plant or a bottom hole assembly drilling tractor system designed so the high fidelity traction control allows for fine rate of penetration control. In some applications, the actuation control system 38 comprises a frequency/RPM control drive mechanism for driving actuatable device 40 in the form of a hammer system. The system 38 also may be used as a power plant for a high-power alternator which enables substantial control over speed variations to be maintained in the presence of flow variations. The progressive cavity system of actuation control system 38 also may be employed as a rotary hammer. Accordingly, the actuation control system 38 and the actuatable device 40 may be constructed in a variety of configurations and systems related to well and non-well applications.

In drilling applications, a fluctuation in collar or bit speed can occur during drilling due to torsional disturbances, and such fluctuations can cause an accumulation of angular motion errors between the actual motion of the drilling system, e.g. bottom hole assembly, collar, bit, or other system, and the desired angular motion (where motion is construed as position, velocity, acceleration, and/or a complex curve). However, the actuation control system 38 can be used to provide improved control over the angular motions. The process of drilling involves many sources of torsional variation that produce a complex wave of disturbances which flow up-and-down a well string and through any mechanism in the well string, such as the various actuatable devices 40 described above. The torque-wave also can cause the pipe work to wind-up, thus causing a stator of a bent-housing mud motor to rotate and further disturb the angular orientation of tool face. In drilling applications, sources of disturbance include reactive torque from the bit, other mud motors in the drill string, drilling through different types of formation, and other environmental and system characteristics. Actuation control system 38 reduces or removes these undesirable angular motions and torques.

The use of actuation control system 38 provides an ability to rapidly "reject" torque disturbances by providing control action local to the point of control, e.g. the bent housing motor, rather than relying on, for example, varying the speed of the surface mud pump in accordance with motor speed data relayed by conventional mud pulse telemetry. Mud flows through an entire drilling system so any device in the drill string that chokes or leaks the flow in an irregular fashion also causes pressure fluctuations at the input to any mud actuated device, such as a mud motor, connected to the drill string which, in turn, causes flow variations that result in angular fluctuation of the rotor. Examples of such sources include fluctuation of rig pump speeds, telemetry methods that utilize positive/negative pressure pulses, telemetry downlinks achieved by varying rig pump speeds, opening/closing of under-reamers, on/off bottom contact by the drill bit, other motors in the drillstring, ball-drop devices, flow-diversion to annulus, alteration in drilling mud composition, and other sources. Utilizing the actuation control system 38 downhole rejects and modifies such influences by providing the control local to the progressive cavity motor/pump. In some applications where surface rotation of the drill pipe impacts the fidelity of control, the rig's rotary table can be operated to adjust rotary table rotation to match downhole requirements at the actuation control system 38. However, the local control of the mud motor or other progressive cavity system of the actuation control system 38 enables higher levels of control fidelity.

Figure 2:
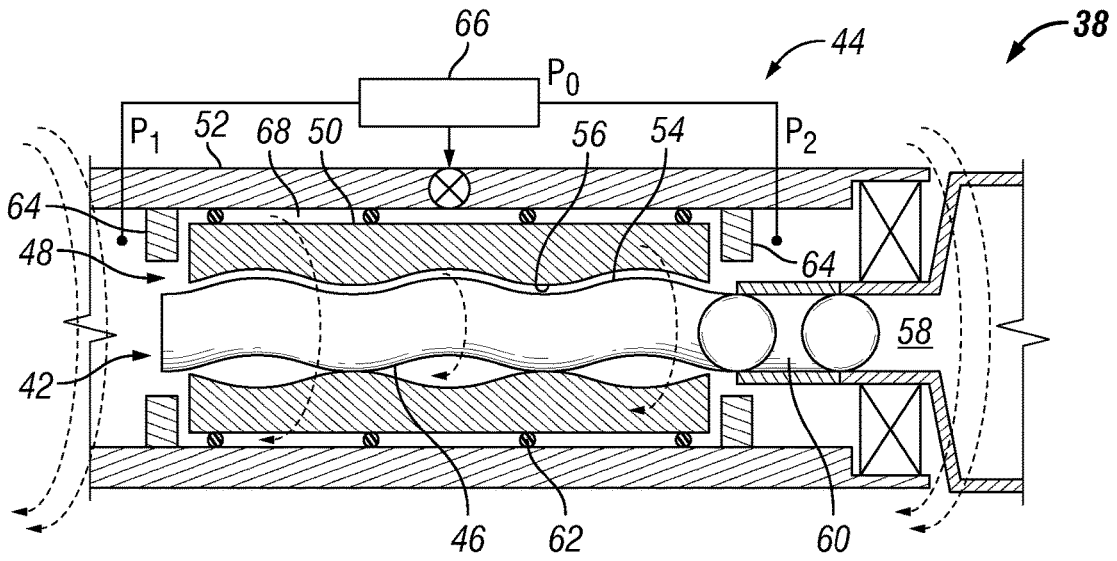
FIG. 2 is a cross-sectional view of an example of an actuation control system, according to an embodiment of the disclosure.

Referring generally to FIG. 2, an example of actuation control system 38 is illustrated in the form of a progressive cavity system 42 and an associated local control system 44. Progressive cavity system 42 may be in the form of a progressive cavity motor or a progressive cavity pump depending on the application. In the example illustrated, the progressive cavity system 42 comprises a rotor 46 rotatably received within a stator or stator system 48. The stator system 48 may be designed with a stator can 50 rotatably mounted within a collar 52. The progressive cavity system 42 is designed to allow the powering fluid, e.g. mud, to flow through the progressive cavity system 42, e.g. mud motor, while allowing the stator can 50 to slip within the collar 52 in a controlled fashion via control system 44.

In the example illustrated, the rotor 46 has an external surface profile 54 and the stator can 50 has an internal surface profile 56 that cooperates with the rotor profile 54. For example, if fluid flow is directed between the rotor 46 and the stator can 50, surface profiles 54, 56 cause relative rotation between the rotor 46 and the stator can 50. It should be noted that if progressive cavity system 42 is used as a pump, relative rotation imparted to the rotor 46 and stator can 50 causes pumping of fluid by cooperating surface profiles 54, 56. By way of example, surface profile 54 may be in the form of a helical surface profile, and surface profile 56 may be in the form of a cooperating helical surface profile.

As illustrated, rotor 46 may be coupled to an output shaft 58 by a suitable transmission element 60. Additionally, stator can 50 may be rotatably mounted in collar 52 via a plurality of bearings 62. The rotation or slippage of stator can 50 relative to collar 52, relative to rotor 46, or relative to another reference point is controlled via control system 44. By way of example, control system 44 may comprise braking elements 64 designed to grip stator can 50 and to thus control the rotation of stator can 50 relative to, for example, collar 52 or rotor 46. The control system 44 also may comprise a control module 66 which may be a processor-based hydraulic control module or an electrical control module designed to activate braking elements 64 hydraulically or electrically. Depending on the desired control paradigm, pressures $P_1$ and $P_2$ may be used to adjust the pressure within the cavity containing fluid 68, thus modulating the friction between stator can 50 and collar 52. By way of example, the modulation may be through direct contact or via a special brake 64 designed to extend and press against stator can 50 to slow its motion in a desired fashion. For example, the brake 64 may be positioned to create a contact area at the stator can ends and/or along the stator can length. The braking device 64 also may be selectively coupled to stator can 50 by an inerter, such as the inerter discussed in US Patent Publication 2009/0139225, where the transfer of energy is first converted to momentum of a spinning body rather than being lost as friction. As discussed in greater detail below, in the case of a high-speed motor, kinetic energy also can be purposefully stored, e.g. stored in the spinning rotor, stator can, and/or actuatable element. However, control system 44 may utilize a variety of other or additional elements to control the slip of stator can 50. In some applications, for example, with suitable sealing and compensation arrangements a magneto-rheological fluid 68 may be located between stator can 50 and collar 52 to selectively limit slippage via controlled changes in viscosity of the fluid 68 through the application of a magnetic field. The material used at the brake contact surfaces may be made of, for example, steel, carbon fiber, aramid fiber composite (e.g. Kevlar, a registered trademark of I.E. DuPont De Nemours), semi-metallic materials in resin, cast iron, ceramic composites, and/or other materials suited to downhole use in either a drilling mud or oil filled environment. It will be appreciated that each of these systems may be combined with additional systems of power, measurement, sensing, and/or communication.

Figure 3:
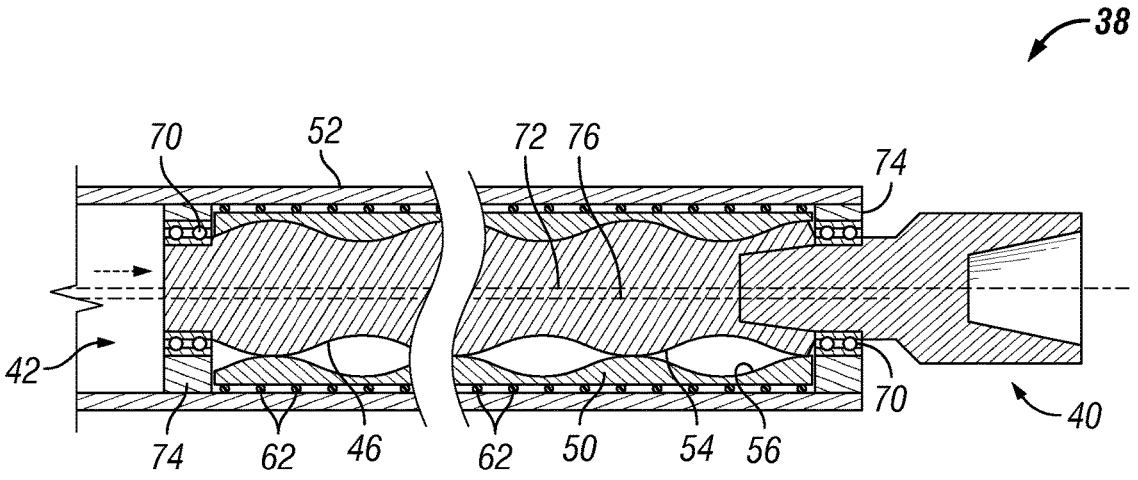
FIG. 3 is a cross-sectional view of another example of an actuation control system, according to an embodiment of the disclosure.

Referring generally to FIG. 3, another embodiment of actuation control system 38 is illustrated in which the stator can 50 has a degree of freedom which allows it to rotate relative to a fixed outer collar structure 52. In a conventional design, the outer motor element known as the stator has an inner helicoidal surface, and the inner motor element known as a rotor has a matching helicoidal outer surface. Together, the rotor and stator form a power section. The conventional power section has a very specific planetary gearing mechanism in that the rotor fulfills a compound movement like a satellite around the planet, i.e. the rotor's axis orbit is the circle having a center which is the fixed stator axis. At the same time, the conventional rotor revolves around its own axis in an opposite direction to the direction circumscribed by its own axis.

In contrast, the embodiment illustrated in FIG. 3 represents a different approach utilizing the stator can 50 which rotates relative to the fixed outer collar 52. The design utilizes eccentric main bearings 70 installed between the rotor 46 and the collar 52 while bearings 62 enable stator can 50 to be rotated relative to collar 52. Simultaneously, the inner motor element, e.g. rotor 46, is constrained in a specific manner. For example, the rotor 46 is constrained such that its axis 72 is fixed at the same position relative to the outer collar 52. Additionally, the rotor 46 has the freedom to be rotated around its own axis 72. In the illustrated example, this type of rotor restraint can be achieved via eccentric bearings 70 mounted to the rotor 46 in cooperation with eccentric support elements 74 which are fixed to the collar 52 to allow rotation of the rotor 46 relative to the collar 52. In this example, both the rotor axis 72 and the stator can axis 76 should be considered as fixed elements with respect to the collar. This means both the rotor 46 and the stator can 50 rotate around their own axes without planetary motion with respect to the collar 52. The rotor axis 72 is shifted relative to the stator can axis 76 a distance equal to the eccentricity of the gerotor mechanism.

Figure 4:
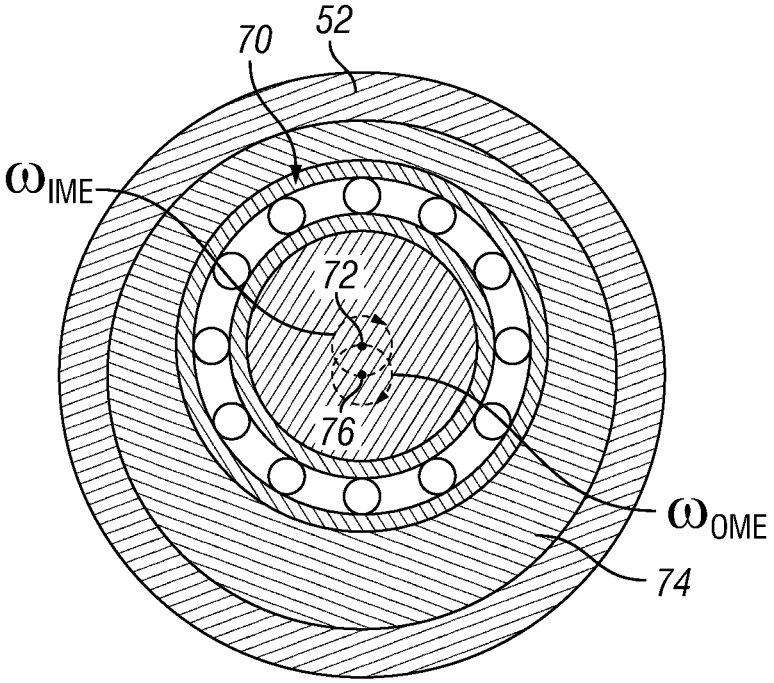
FIG. 4 is a cross-sectional view taken along a plane extending through an end bearing of the system illustrated in FIG. 3, according to an embodiment of the disclosure.
Figure 5:
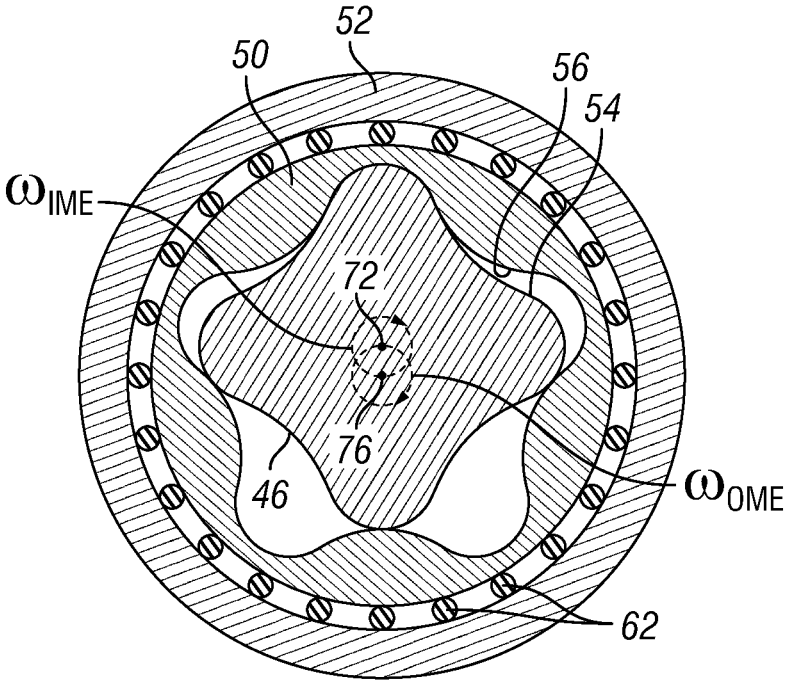
FIG. 5 is a cross-sectional view taken along a plane extending through a rotor generally perpendicular to an axis of the rotor of the system illustrated in FIG. 3, according to an embodiment of the disclosure.

With additional reference to FIGS. 4 and 5, if we assume the $\omega_{IME}$ is the rotor RPM with respect to the collar, $\omega_{OME}$ is the stator RPM with respect to the collar, $z_1$ is the number of stator lobes, and $z_2=z_1-1$ is the number of rotor lobes, then the ratio between stator and rotor RPM will be defined as:

$$\omega_{OME}/\omega_{IME}=z_2/z_1$$

At the same time the rotor RPM will be substantially higher compared to the classical planetary mechanism with equivalent input data (the same size/configuration, flow rate and differential pressure). This beneficial increase in rotor output speed is caused by the bearing constraint that prevents the rotor axis 72 from orbiting that of the stator can 50. In a conventional motor the orbit is in a direction opposite to rotor rotation, but by preventing this backwards rotation with respect to the collar the speed of the rotor is enhanced in the forward direction. If we assume the $\omega_{IME\text{-}NEW}$ is the RPM of the 'new kinematics' mechanism, $\omega_{IME\text{-}CLASSIC}$ is the RPM of classical equivalent mechanism, an estimated ratio between these rotary speeds (RPM) is approximately:

$$\omega_{IME\text{-}NEW}=z_1*\omega_{IME\text{-}CLASSIC}$$

In terms of transmitted torque (TQ) the situation is different. If we assume the $TQ_{IME\text{-}NEW}$ is the torque of the 'new kinematics' mechanism and $TQ_{IME\text{-}CLASSIC}$ is the torque of the classical equivalent mechanism, then an estimated ratio between these torques is approximately:

$$TQ_{IME\text{-}NEW}=TQ_{IME\text{-}CLASSIC}z_1.$$

In the case of a pump it would take $z_1$ rotations of the rotor to pump the same amount of fluid as in a conventional progressive cavity pump of the same lobe descriptions. This also means that for the same input torque the rotatable stator can motor would also be able to generate a higher output pressure differential-effectively $z_1$ times higher pressures, provided the sealing design is adequate.

The embodiment illustrated in FIGS. 3-5 provides a system in which the lateral forces reacted by the collar 52 generated by the rotations of the rotor 46 and the stator can 50 are close to zero because both the rotor 46 and the stator can 50 spin about collar-fixed axes, i.e. there is no planetary movement of the rotor 46 with respect to the collar 52. This substantially reduces vibration levels due to the reduction in the severity of inertial forces. Because there is no transformation of planetary motion into rotational motion, this type of system can be employed to simplify the universal joint, knuckle joint, or flexible transmission element 60 in some applications. Consequently, this type of system may be operated at a higher RPM level when compared with conventional mud motors. Additionally, because the rotor axis 72 is offset from the axis of collar 52, this type of actuation control system 38 may be used in various steerable systems, such as steerable drilling systems. The axis offset or eccentricity of the bit central axis from the collar central axis may be directionally controlled to perform a steering function. Additionally, this type of actuation control system 38 may be employed in a variety of other applications and may be connected with many different mechanisms, e.g. an electric generator, a gearbox, a controllable lead screw, and other suitable mechanisms.

Figure 6:
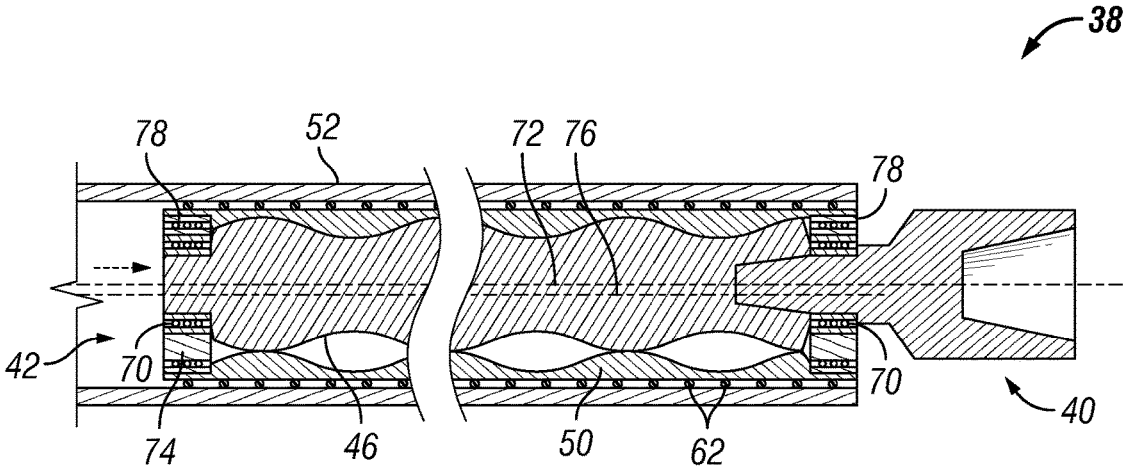
FIG. 6 is a cross-sectional view of another example of an actuation control system, according to an embodiment of the disclosure.
Figure 7:
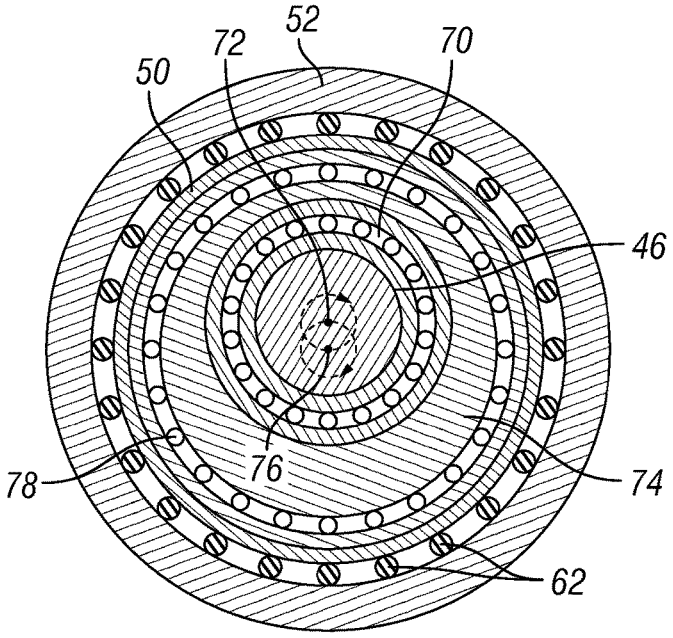
FIG. 7 is a cross-sectional view taken along a plane extending through an end bearing of the system illustrated in FIG. 6, according to an embodiment of the disclosure.

The components in this type of actuation control system 38 (see FIGS. 3-5) may be arranged in a number of related configurations, such as those illustrated in FIGS. 6-14. In many applications, a control system such as control system 44 may be used with these embodiments to control torque and rotary motion output. Referring initially to FIGS. 6-7, an embodiment is illustrated in which the bearing 70 is decoupled from the collar 52 by an additional bearing 78 positioned between each bearing 70 and stator can 50. However, the eccentricity of the rotor 46 is maintained via bearings 70. As actuating fluid, e.g. drilling mud, is pumped through the actuation control system 38, the rotor 46 rolls within the stator can 50 and proscribes an orbit such that the rotor 46 wobbles about the central axis 76 of the stator. However, the phase relationship of the eccentricity is enforced by the geometric constraint of the rotor and the stator. By way of example, such a design could be used to actuate an agitator or other device designed to utilize the "wobble" output. The additional stator can bearing 62 shown in FIG. 6 provides an additional degree of control freedom to adjust the frequency of wobble and to adjust the rotational speed out and the torque output by suitable introduction of control system 44.

Figure 8:
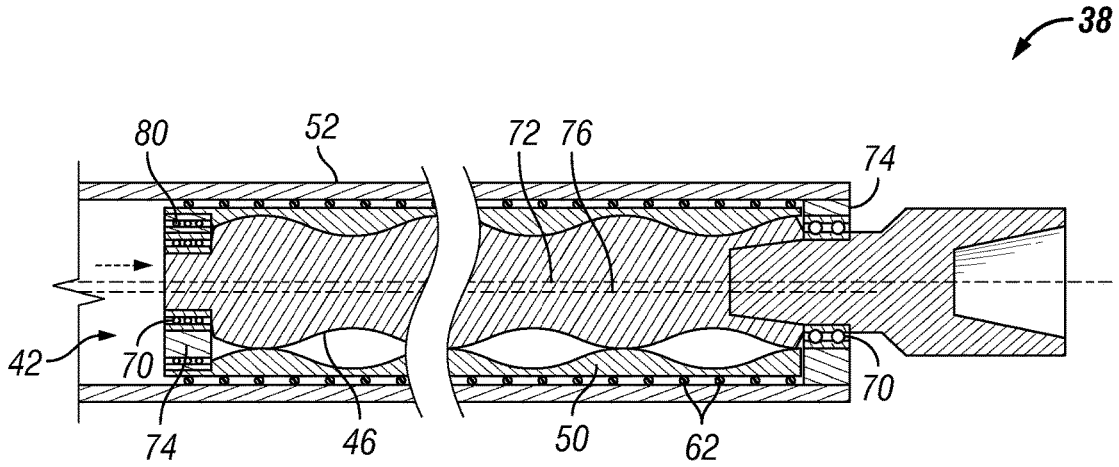
FIG. 8 is a cross-sectional view of another example of an actuation control system, according to an embodiment of the disclosure.
Figure 9:
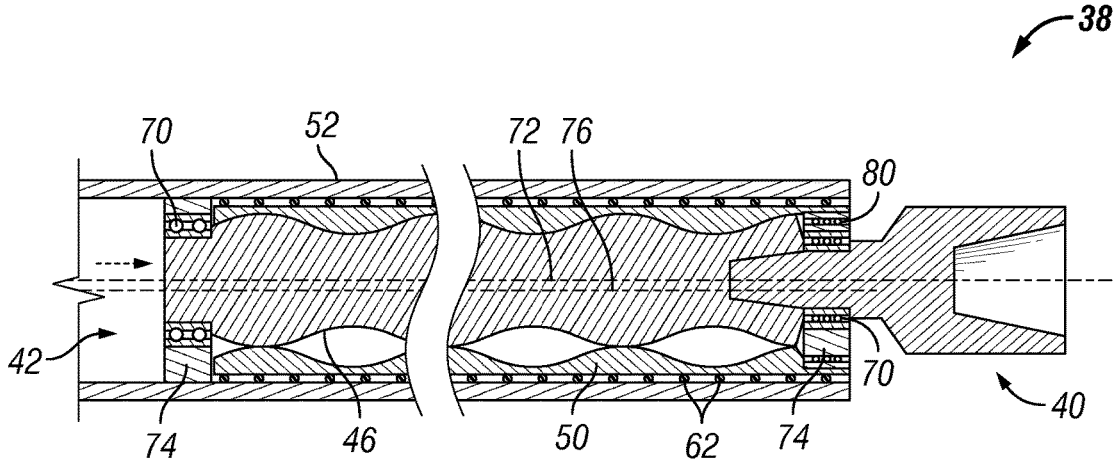
FIG. 9 is a cross-sectional view of another example of an actuation control system, according to an embodiment of the disclosure.

Referring generally to FIG. 8, another related embodiment is illustrated which is similar to the embodiment described above with respect to FIGS. 3-5. However, the embodiment illustrated in FIG. 8 adds a radially outer bearing 80 located on the illustrated left end of the rotor 46. The outer bearing 80 is connected with the stator can 50 between the eccentric support 74 and the radially inward eccentric bearing 70. The bearing 70 on the illustrated right end may be affixed to the collar 52 via eccentric support 74. In this example, the phasing of the rotational elements follows the kinematic constraints of the progressive cavity system. Thus, the rotor axis remains collar fixed and the bearings 62, 70 and 74 all rotate to follow the kinematic constraints of the progressive cavity system. FIG. 9 illustrates an embodiment similar to that illustrated in FIG. 8, but the additional, radially outer bearing 80 has been positioned on the illustrated right end of the rotor 46. The bearing 70 on the illustrated left end is affixed to the collar 52 via eccentric support 74. The embodiments illustrated in FIGS. 8 and 9 can be used as high-speed motors to provide higher rotational output speeds in many applications not normally serviced by progressive cavity type systems.

Figure 10:
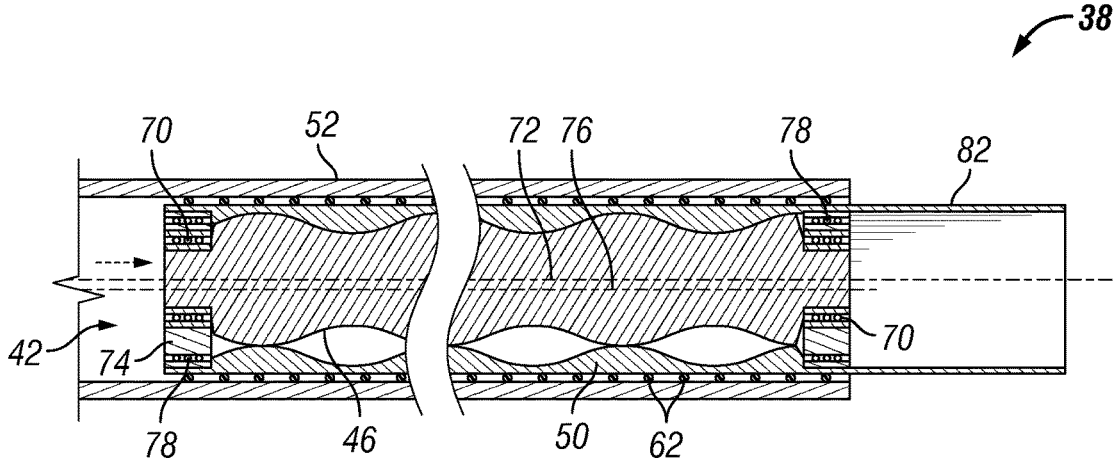
FIG. 10 is a cross-sectional view of another example of an actuation control system, according to an embodiment of the disclosure.
Figure 21:
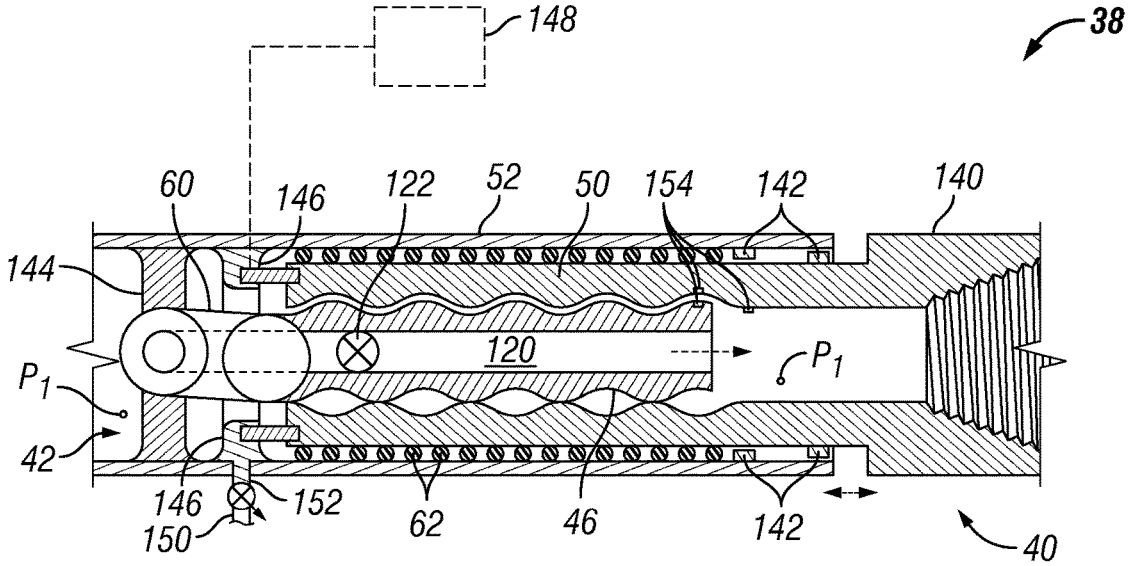
FIG. 21 is a schematic view of another example of an actuation control system, according to an embodiment of the disclosure.

Referring generally to FIG. 10, another related embodiment is illustrated which is similar to the embodiment described above with respect to FIGS. 6-7. In this embodiment, however, the left hand end of the rotor 46 is constrained from rotating by, for example, a universal joint fixed at one end of the collar 52 (e.g. see left-hand side of FIG. 21 illustrating an example of this type of restraint). Instead of the rotor 46 being the driving element, this embodiment utilizes the stator can 50 as the driving element via a drive extension 82. The drive extension 82 may be coupled to a variety of actuatable devices 40. The larger diameter of drive extension 82 may enable the transfer of a higher level of torque to the actuatable device 40. In this example, the stator can 50 rotates within collar 52, and thus a brake or brakes 64 may be employed to provide a desired modulation as with the embodiment illustrated in FIG. 2. It will be appreciated that the output speed to flow input will be similar to a conventional mud motor because this version is not a high-speed motor version. The same effect could be achieved by removal of bearings 70, 74 and 78 although the beneficial effects of constraining the radial extent of rotor displacement into the sealing medium of the motor would be lost. It should be noted that this embodiment and other embodiments embodiments discussed herein enable construction of a shorter motor stage without loss of power.

Figure 11:
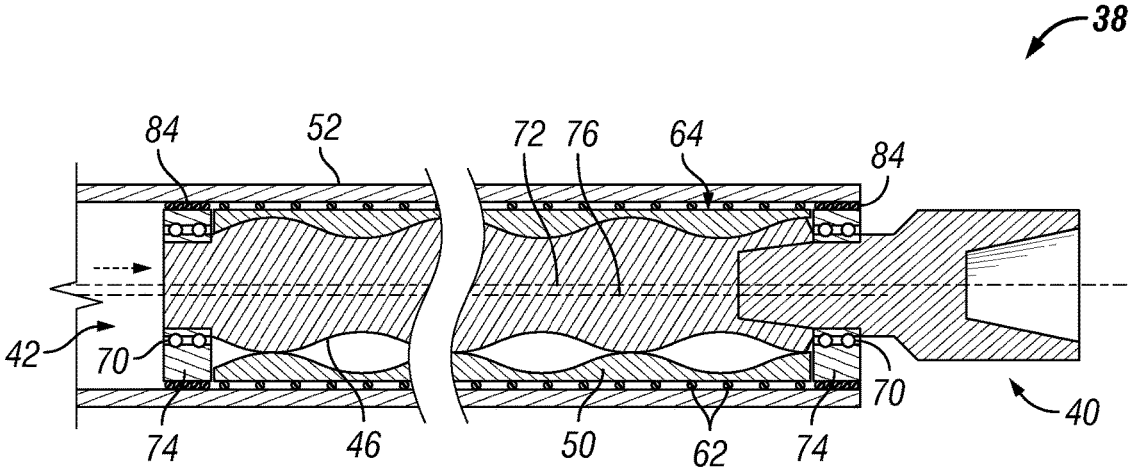
FIG. 11 is a cross-sectional view of another example of an actuation control system, according to an embodiment of the disclosure.
Figure 12:
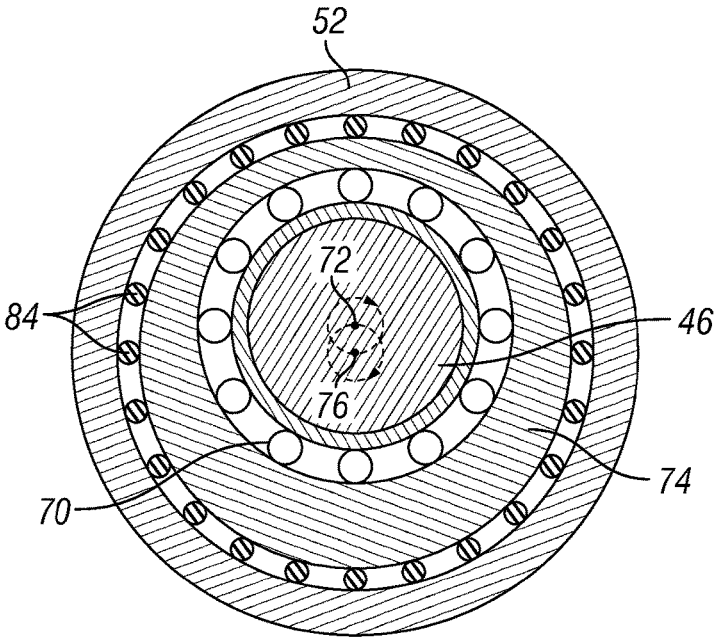
FIG. 12 is a cross-sectional view taken along a plane extending through an end bearing of the system illustrated in FIG. 11, according to an embodiment of the disclosure.

In the embodiment illustrated in FIGS. 11-12, the rotor 46 is connected to collar 52 by eccentric bearings 70 and by a radially outlying bearing 84 while stator can 50 is mounted independently within collar 52 via bearing 62. In this example, torque is not output until frictional drag is created between the stator can 50 and the collar 52. A brake or brakes 64 may be used to apply the desired friction between stator can 50 and collar 52 to create a desired torque output. If rotation of stator can 50 is prevented relative to the collar 52 and if full rotational freedom is provided to the eccentric bearing, the rotor 46 can be used in the same manner as a classical power section design. The movement will be planetary. In this case, the rotor can be connected to an output shaft, e.g. drive shaft, using a universal joint. Then, the rotary speed of that shaft can be described by $\omega_{IME\text{-}CLASSIC}$ as discussed above. If we prevent rotation of the eccentric bearing relatively to the collar 52 and provide full rotational freedom to the stator can 50 and the rotor 56, the rotor 56 behaves similarly to the embodiment illustrated in FIGS. 3-5. In this case, the rotor 46 is rotated relative to its own axis and the rotary speed can be described as $\omega_{IME\text{-}NEW}$ discussed above. If clamping forces are independently applied to the stator can 50 and the eccentric bearing via, for example, brake 64 to control their RPM relative to the collar 52, the output rotary speed of rotor 46 can be controlled within the range $\omega_{IME\text{-}CLASSIC} \ldots \omega_{IME\text{-}NEW}$. It should be noted that this type of design also may be utilized as a high-speed motor.

Figure 13:
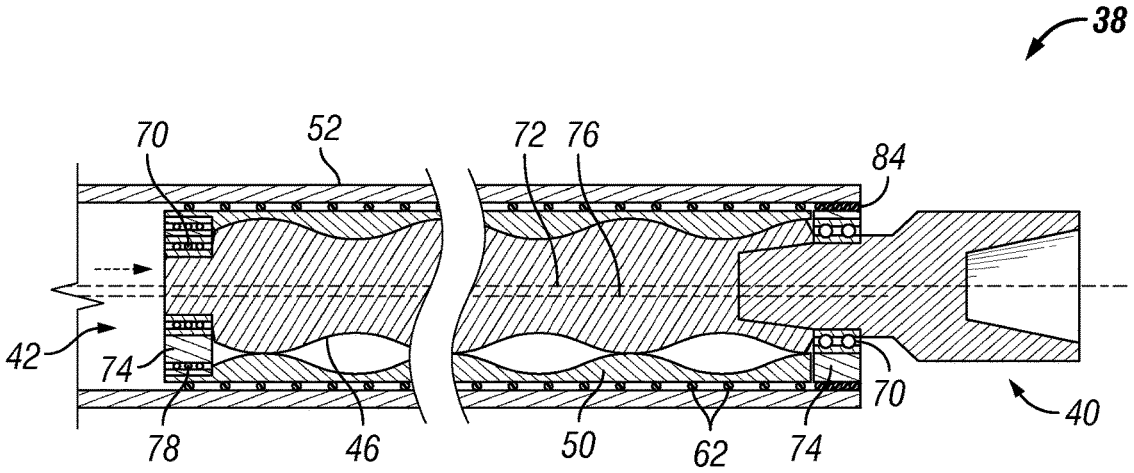
FIG. 13 is a cross-sectional view of another example of an actuation control system, according to an embodiment of the disclosure.
Figure 14:
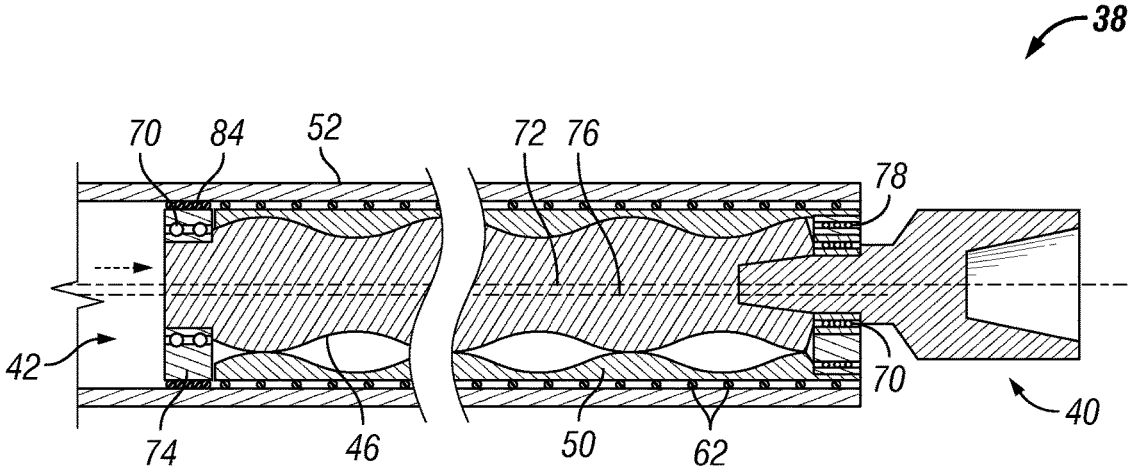
FIG. 14 is a cross-sectional view of another example of an actuation control system, according to an embodiment of the disclosure.

Referring generally to FIGS. 13 and 14, additional embodiments of the actuation control system 38 are illustrated. These embodiments are similar to various embodiments described above and are generally useful as, for example, low speed motors. The output provided by the progressive cavity systems in these embodiments will tend to wobble. As illustrated in FIG. 13, bearings 70 and 78 are positioned between stator can 50 and rotor 46 at a left end of the assembly, while bearing 70 and 84 are positioned between collar 52 and rotor 46 at a right end of the assembly. In the embodiment illustrated in FIG. 14, the bearings 78 and 84 are reversed and placed at opposite longitudinal ends of the assembly relative to the embodiment of FIG. 13. It should be noted that in the embodiments illustrated in FIGS. 3-14, as well as other embodiments described herein, suitable flow paths are created to enable flow of actuating fluid, e.g. drilling mud, between the rotor 46 and the surrounding stator, e.g. stator can 50.

Figure 15A:
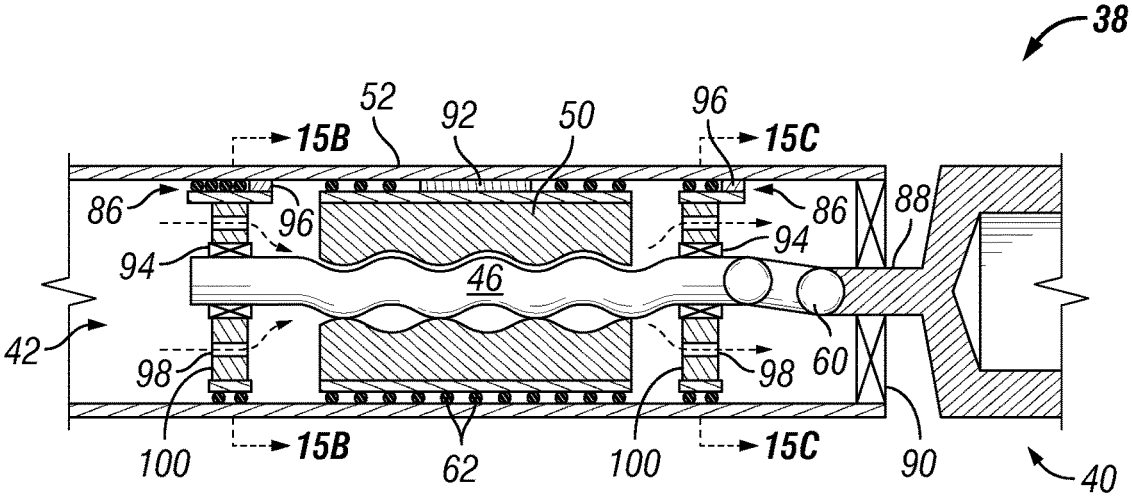
FIGS. 15A-15C are views of another example of an actuation control system, according to an embodiment of the disclosure.
Figure 15B:
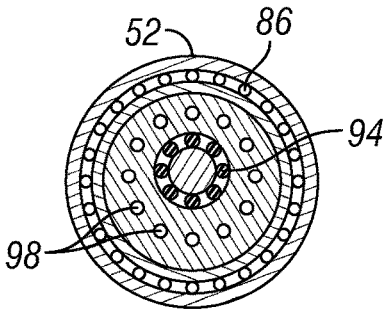
Figure 15C:
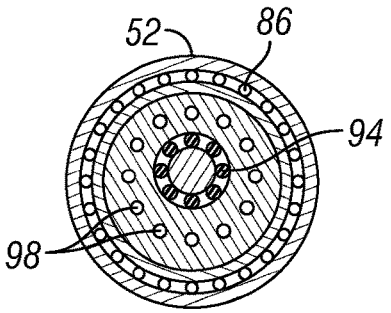

Referring generally to FIG. 15, an embodiment of the actuation control system 38 is illustrated in the form of a progressive cavity motor which can operate at two different speeds, e.g operate as a high-speed motor or a low speed motor. By way of example, this type of system may be used in many drilling operations where it may be desirable to vary the torque-speed relationship of the mud motor 38. In this example, bearings 86 are used to rotatably mount rotor 46 within collar 52, and the operation of those bearings 86 may be selectively switched between constrained and free. The rotor 46 may be coupled to actuatable device 40, e.g a drive shaft 88, via universal coupling 60. The bit shaft 88 may be rotatably mounted within collar 52 by suitable shaft bearings 90.

In this embodiment, the stator can 50 may be free to rotate with respect to collar 52 or it may be selectively locked with respect to collar 52 by a lock 92, such as a friction lock or other suitable locking mechanism. The longitudinal ends of the rotor 46 are restrained by outer bearings 86 and inner bearings 94. The outer bearings 86 rotate concentrically to the collar 52 (or nominally so) and carry the inner bearings 94 which are eccentrically mounted. The outer bearings 86 are either free to rotate or are locked with respect to the collar 52 via locks 96. In the illustrated example, the angular locking positions of both longitudinal ends of rotor 46 are the same, i.e. the eccentricities of the inner bearings 94 are aligned when locks 96 are actuated and locked to resist/block free movement via outer bearings 86.

When lock 92 is engaged and both locks 96 are open, the mud motor 38 behaves like a conventional mud motor in which flow causes rotor 46 to rotate within the stator can 50, exhibiting normal eccentric gyration of the rotor 46. In this configuration, the mud motor 38 possesses the drive characteristics of a conventional mud motor other than being radially restrained. When lock 92 is open or disengaged and both locks 96 are locked or engaged, the mud motor 38 behaves like a high-speed motor, such as the high-speed motor embodiments described above. By way of example, locks 92, 96 may be constructed in a variety of forms and may comprise clutches, teeth, latches, stops, friction surfaces, and other suitable locks; and the motive means for actuating the locks may comprise electric motors, magnetic devices, hydraulic devices (mud or oil) piezoelectric devices, and other suitable actuating devices. It should further be noted that in the illustrated embodiment openings 98 have been formed through bearing support structures 100 which are used to support and carry bearings 86 and 94. The openings 98 enable flow, e.g. drilling mud flow, through the actuation control system/mud motor 38. Similar openings to enable flow may be used in other embodiments described herein, such as the embodiments illustrated in FIGS. 3-14.

In some applications, lock 92 may be constructed as a brake, e.g. brake 64, rather than as a "stop-go" or "on-off" device. This allows the actuation control system 38 illustrated in FIG. 15 to also function as a servo-type device similar to that described above with reference to FIG. 2. The modulated, servo action can be incorporated into the two speed motor design by providing controlled braking between stator can 50 and collar 52 in either the high-speed or low-speed configuration. Similarly, as described with respect to FIGS. 11 and 12, the locking device 96 may be converted into a slipping clutch or brake so that the orbiting speed of the rotor's central axis may be controlled between zero (locked) and intermediate speeds up to fully open, thereby providing an additional approach for modulating speed and torque output.

Figure 16:
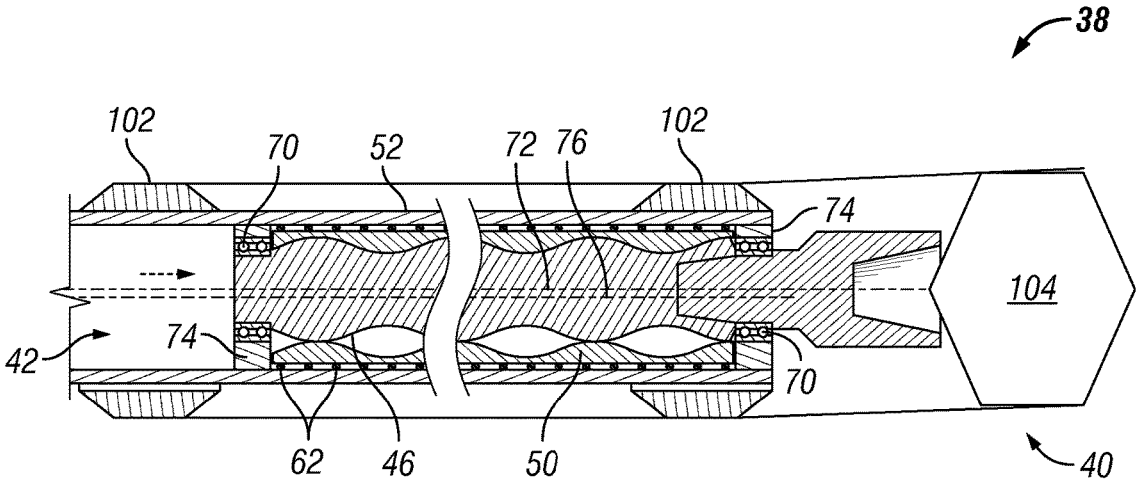
FIG. 16 is a cross-sectional view of another example of an actuation control system, according to an embodiment of the disclosure.

In several of the high-speed motor embodiments described above, the output (e.g. an output shaft driving a drill bit) is eccentric with respect to the axis of the collar 52. In the case of driving a drill bit, this means the hole being drilled is generated to one side of the collar axis and naturally provides a steering effect. By combining the offset axis of the output with near bit and far bit stabilizers 102 (as illustrated in FIG. 16), the system may be adapted to define the three borehole touch points utilized in generating a borehole curve via a drill bit 104. The drill string/collar 52 can simply be rotated to change the drilling direction. In a variety of drilling systems, the rotation to change the drilling direction may be implemented from a surface location, however the rotation to change drilling direction also may be implemented from an orienter. In some applications, a servo-type actuation control system 38, such as that illustrated in FIG. 2, may be used as the downhole orienter.

Figure 17:
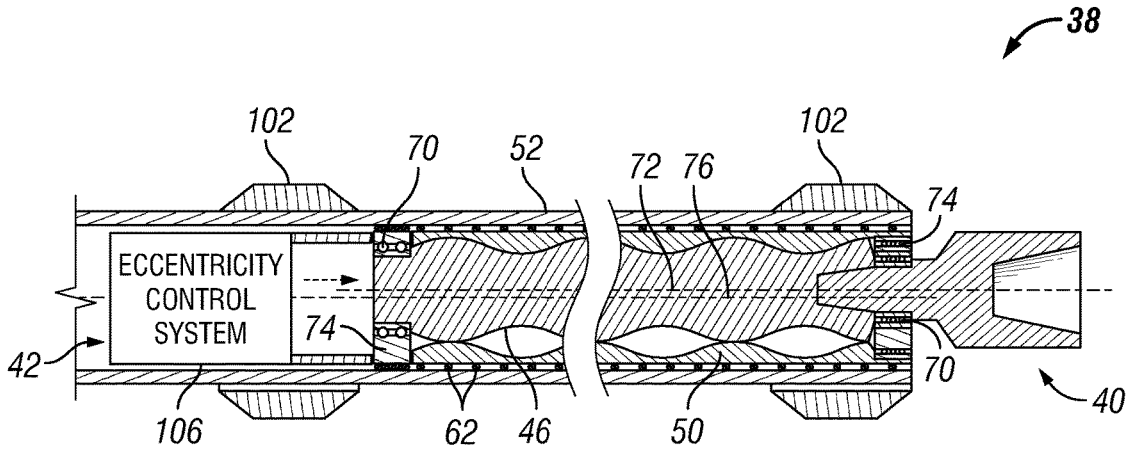
FIG. 17 is a cross-sectional view of another example of an actuation control system, according to an embodiment of the disclosure.

If the eccentricity of the output is mobile with respect to the collar 52, then it is possible to "point" the direction of eccentricity independently of collar rotation, including holding that direction geostationary as the collar 52 rotates. This type of construction provides a rotary steerable system. In the embodiment of FIG. 17 the general embodiment of FIG. 14 has been converted to a rotary steerable motor by adding an eccentricity control system 106. The eccentricity control system 106 may be selectively operated to rotate the illustrated left side eccentricities direction of pointing with respect to the collar 52. This means the collar 52 can be rotating at one speed and the control system 106 can be rotating in an opposite direction at the same speed with respect to the collar 52, thus holding the eccentricity on the illustrated left side in a geostationary position. In other embodiments, the eccentricity control system 106 can be rearranged to position the eccentricity at the illustrated right side or the eccentricities can be motivated simultaneously on both the left and right sides of the rotor 46. This embodiment is designed to provide an ability to independently control the direction of the eccentric offset without defeating the motor capabilities described above. In some applications in which the collar 52 is in a stationary but unknown position and the eccentricity control system is informed, or can calculate, that the bit's offset eccentricity should be in a given direction, the eccentricity control system can simply be a brake that stops the reactive rotation of the stator can in the desired direction, thereby avoiding incorporation of a separate motor into the eccentricity control unit.

Figure 18:
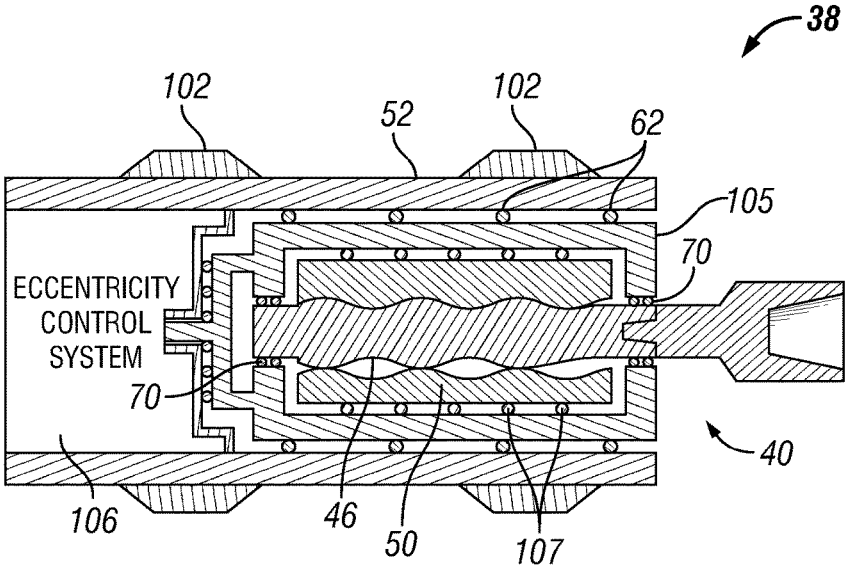
FIG. 18 is a cross-sectional view of another example of an actuation control system, according to an embodiment of the disclosure.

In some applications, the alignment of the eccentric bearings, e.g. bearings 70, illustrated in FIG. 17 may be further facilitated by connecting them via a sleeve 105, as illustrated in FIG. 18. In this latter embodiment, the sleeve 105 is rotatable by the eccentricity control system 106 on the set of bearings 62 to point the eccentricity of the bit in the desired direction of drilling. As with the other embodiments described herein, the bearings 70 are eccentric with respect to another set of bearings, e.g. bearings 107. Bearings 107 and 62 also could be mutually eccentric but in many applications they may be mutually concentric. Similarly, the central axes of the collar 52 and bearing 62 could be eccentric but in many applications they are mutually concentric. In some embodiments, the eccentricity control system 106 can be situated at the other end of the system. Additionally, in some embodiments, the connecting sleeve 105 may be replaced altogether using two eccentricity control systems 106 placed at opposite ends of the system. If two eccentricity control systems 106 are employed, their actions may be coordinated to achieve the desired positioning of the bearing eccentricities to, for example, control the direction of eccentric offset. In some of these applications, the sleeve 105 may be split along its length and each portion of the split sleeve may be controlled by a separate eccentricity control system 106, thus retaining a shared but split use of the bearing connecting the separate portions of sleeve 105 to the collar 52. Additionally, the stator can may be mounted on the collar 52 by a fourth bearing in a gap provided between the portions of sleeve 105. This may be accomplished by shortening the length of the two sleeve portions in the direction of the stator can ends and removing the bearing by which the stator can is rotatably mounted in the sleeve. In appropriate circumstances, the simpler system of using a braking mechanism within the eccentricity control system(s) 106, as described in the preceding paragraph, also can be used.

In a variety of applications, the mutual rotational alignment of two eccentric bearings, e.g. bearings 70, 107, may be useful in achieving the desired actuation. In some applications, the eccentric bearings may be fixed by design and in other applications the bearings may be allowed to rotate independently by mounting them on additional bearings which allow the eccentricities to rotate to different circumferential positions. In some applications, the eccentric bearings may be linked by a sleeve, e.g. sleeve 105, or by an eccentricity control system so that the eccentric bearings move in unison or in another desired relationship. Additionally, some applications may utilize structures in which the two sets of eccentric bearings are nominally aligned but have a limited amount of flex or freedom. This flex or freedom may be used to accommodate, for example, system distortions, manufacturing imperfections, and/or wear.

The embodiments described above are designed to allow the stator can 50 to rotate within the collar 52 in different manners. In the embodiment illustrated in FIG. 19, however, a new degree of freedom to the stator can 50 is introduced by allowing it slide axially within the collar 52. By way of example, this embodiment of actuation control system/mud motor 38 comprises a driveshaft 108 slidably coupled with collar 52 via sliding bearings 110 and a sliding clutch 112. The driveshaft 108 extends into engagement with a desired, actuatable device 40. Additionally, the sliding clutch 112 is rotatably mounted with respect to driveshaft 108 via bearings 114.

Sliding clutch 112 controls the extent of axial sliding movement. The sliding bearings 110 are axially connected to the stator can 50 by a rotary bearing 116 which allows the stator can 50 to axially move with the sliding bearing 110 while allowing the stator can 50 to rotate independently of the sliding bearing 110. A rotary clutch 118 controls the relative motion between the stator can 50 and the sliding bearing 110. Additionally, the driveshaft 108 may be rotatably connected with the sliding bearing 110/sliding clutch 112 via bearings 114 and to the rotor 46 via flexible coupling 60 to accommodate eccentric motion of the rotor 46. If the sliding clutch 112 and the rotary clutch 118 are both locked, the result is a conventional type mud motor. If, on the other hand, the rotary clutch 118 is allowed to slip, the controlled slip provides a servo-type motor. If both the sliding clutch 112 and the rotary clutch 118 are locked, the sliding clutch 112 may be selectively released so that pressure acting on the system drives the stator can 50 toward a travel limit stop 119. The extent of axial travel of the stator can 50, sliding bearings 110, and bit (or other load) may be constrained by axial stops, e.g. stops 119. In the illustrated embodiment, the axial load causing the system to extend or retract via sliding bearings 110 is determined by the pressure differential between the lead end/top of the stator can 50 and the annulus pressure at the lower end of the sliding bearings 110 suitably modified by intervening effective piston areas. This loading may be referred to as the differential effective pressure force.

The combination of the sliding clutch 112 and the rotary clutch 118 allows the actuation control system 38 to be used in performing a variety of tasks. In addition to the actions described above, releasing the rotary clutch 118 while the sliding clutch 112 is locked, causes the stator can 50 to rotate with respect to the collar 52. As a result, the pressure differential across the system/mud motor 38 is reduced which, in turn, causes the drive speed and torque output by driveshaft 108 to be reduced. The rotary clutch 118 can be relocked to selectively cause the system to behave as a conventional mud motor.

When the rotary clutch 118 is locked, disengaging the sliding clutch 112 causes the axial load imparted against device 40, e.g. against a drill bit, to be determined according to whether the stator can 50 is on or off the travel stops 119 and on the differential effective pressure force. If, for example, the system is fully retracted and resting against a travel stop 119, then the push load transferred to the drill bit (or other actuatable device) is determined by the axial loads from the collars, e.g. collar 52, located above. If, on the other hand, the system is fully retracted and resting on a travel stop 119 while a pull force is applied, the load transferred to the drill bit is determined by the clutch friction of sliding clutch 112 modified by differential effective pressure force acting to extend the system. If the system is fully extended and against a stop 119, then a pull load transferred to the drill bit is determined by the upper pull force acting on the collar 52. Similarly, if the system is fully extended and against a stop, then a push load transferred to the drill bit is determined by the clutch friction of sliding clutch 112 and the differential effective pressure force. When the system is midrange between stops 119, then push or pull loads are transferred to the bit according to the differential effective pressure force and the sliding clutch loads.

The sliding clutches 112 or 118 may be designed to modulate system pressure and/or to perform other tasks, such as to absorb vibrations or impulses by allowing a predetermined amount of sliding motion. The stator can 50 may be moved in an opposite direction by applying weight on bit or by other suitable methods depending on the application of system 38. Additionally, the sliding clutches 112 or 118 may be designed to modulate resistance as desired for a given application.

In a drilling application, maintaining the axial movement of stator can 50 over and around its mid-position may be helpful in providing maximum opportunity for extending or retracting on short notice to accommodate control disturbances via a quick extension or retraction of the system. Additionally, sliding clutch 112 and rotary clutch 118 may be operated in an intermittent manner individually or collectively to generate a desirable form of vibration to enhance drilling by modifying the rock destruction process and/or by modifying the frictional effects that limit the transfer of weight to the drill bit. These axial and rotary degrees of freedom also may be used to dampen the deleterious effects of other sources of drill string vibration, e.g. stick slip and bit bounce. One or both of the sliding clutch 112 and the rotary clutch 118 also may be set to slip at predefined levels to act as a load or torsional override for a given application. The system may be designed to enable changing of the predefined levels by, for example, using electrically controllable clutches.

The sliding and rotary clutches 112, 118 also may be employed to transmit telemetry data to the surface as their intermittent or variable operation give rise to pressure (and/or torsional or axial waves) that propagate to the surface and may be decoded by a suitable control system. In some applications, information transmitted by the clutches may be related to sensor measurements or system status codes. In other situations, the waves propagating to the surface may be used as indications of actuator motion and as a direct confirmation of actuation taking place downhole. The performance of the downhole control systems equipped with such telemetry systems can be enhanced by coordinating the action of the downhole, actuation control system 38 with that of surface systems, such as surface rig mud pumps, draw works, rotary tables, top drives, and/or other surface systems. With higher speed communication systems, as provided by wired drill pipe, the bandwidth response of this type of coordination can be enhanced and is capable of maintaining the downhole, actuation control system 38 (via clutches 112, 118) within its operational range in the presence of much higher disturbances than can otherwise be accommodated for mud pulse telemetry in this embodiment and other embodiments described herein.

It should be noted that when both the axial and rotary clutches 112, 118 are controlled simultaneously, their actions are coupled and an associated control system may be designed to evaluate the proportions and timing of output due to actions from the clutches 112, 118 and bypass control, e.g. the bypass valve discussed below. For this embodiment and other embodiments described herein, the associated control system may have a variety of configurations and may be designed to utilize sensors to sense parameters such as: linear displacement of stator can 50; velocity/acceleration of the sliding clutch 112 in inertial or collar fixed axes; rotational speed of the stator can 50 by measuring inertial or relative rotation with respect to the collar 52; rotational speed of rotor 46 with respect to the collar 52, the inertial space, or the stator can 50; pressure at the input and output ends of the mud motor 38 and at the output of the sliding bearings 110; torque and load upstream and/or downstream of the mud motor 38; and/or other parameters.

Figure 19:
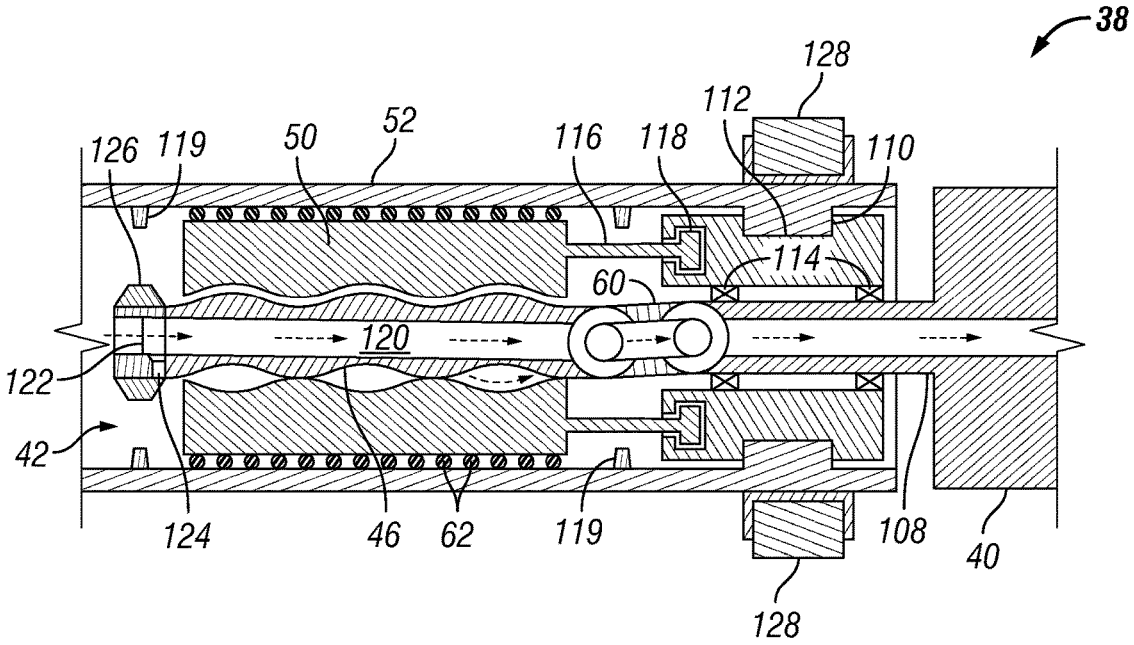
FIG. 19 is a schematic view of another example of an actuation control system, according to an embodiment of the disclosure.

In the embodiment illustrated in FIG. 19, a channel 120 is located longitudinally through the rotor 46, e.g. along the axis of the rotor 46, and is used to allow a controlled amount of drilling fluid (or other actuating fluid) to bypass the "Moineau" action of the mud motor 38. However, such a bypass 120 may be employed in a variety of applications. In the illustrated application, bypass flow may be controlled by a valve 122 located in, for example, an end of the rotor 46 to effectively control the amount of fluid flow between rotor 46 and stator can 50. Control over valve 122 may be achieved via energy and information electromagnetically transmitted to a valve control system 124. Or, power to the valve control system can be generated by a turbine alternator 126 positioned at a suitable location, such as the illustrated left end of rotor 46. The electronics for the valve control system 124 also may be carried at the lead end of the rotor 46. Power and/or data may be communicated to/from the valve control system 124 by a variety of communication systems, such as electromagnetic communication systems or pressure/flow pulse telemetry systems utilizing pressure pulses carried by the drilling mud. Power and/or data also can be supplied via a slip ring connection capable of accommodating the rotational and/or axial motion of rotor 46. It should be noted that a variety of bypass arrangements in addition to or other than bypass channel 120 may be employed to selectively control the amount of actuating fluid flowing between rotor 46 and stator can 50. For example, porting to the annulus may be formed through the wall of collar 52 at a lead end of the motor. The bypassing of fluid can be incorporated into many of the embodiments described herein to provide an additional level of control on the system performance.

Depending on the application of system 38, a plurality of steering actuators 128 also may be added to the design to provide a steerable system for use in directional drilling or other steering applications. By way of example, steering actuators 128 may be mounted to collar 52 proximate sliding clutch 112 for controlled radial extension to effectively maintain or change the direction of drilling. The steering actuators 128 may be operated according to push the bit principles. In some applications, the axis of sliding with respect to the sliding bearing 110 (and its surrounding collar) can be laterally and/or angularly offset of the central axis of the collar 52 to implement an offset or point the bit steering system. In drilling applications, such an arrangement can be used to cause the hole to be generated at an offset location with respect to a lower stabilizer, thus causing the hole to be drilled along a curve. In this type of system, steering is controlled by manipulating the direction in which the offset is oriented. Also, the axial and rotary coupling between the stator can 50 and the sliding bearing 110 may be made as a compliant/flexible/telescopic coupling to accommodate relative swashing motion. It should be further noted that many of the embodiments described herein may be equipped with steering actuators 128 when device 40 comprises a drill bit. Such steering actuators 128 may be designed as collar fixed or as able to rotate with respect to the collar 52 on a separate steering sleeve or other suitable device.

Figure 20:
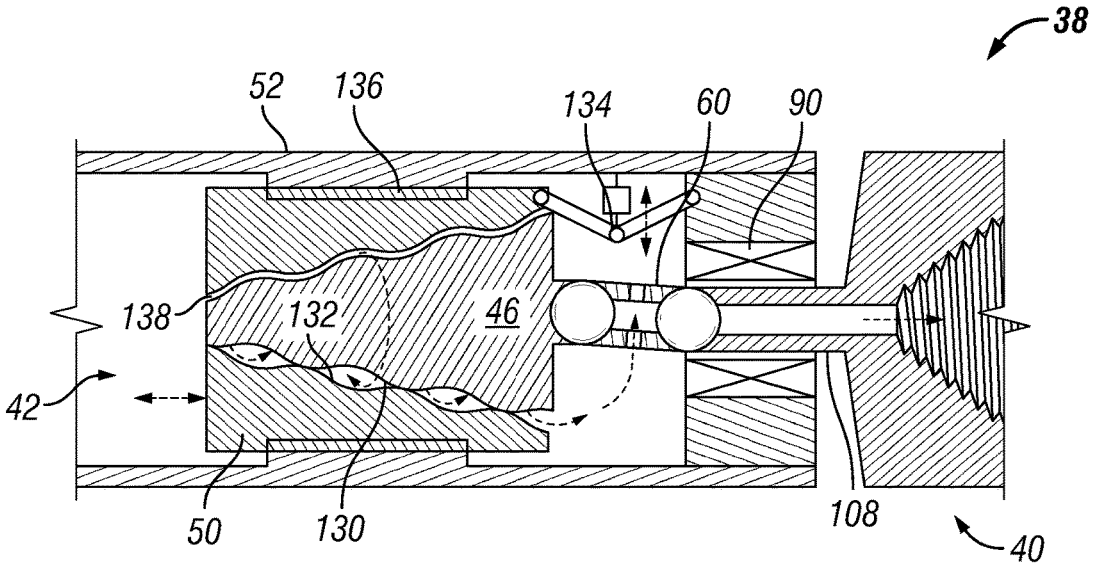
FIG. 20 is a schematic view of another example of an actuation control system, according to an embodiment of the disclosure.

Referring generally to FIG. 20, another embodiment of actuation control system 38 is illustrated. In this embodiment, rotor 46 is formed as a tapered rotor having a generally tapered outer surface 130. Similarly, stator can 50 is formed with a corresponding tapered interior defined by a tapered interior surface 132. The tapered surfaces enable adjustment of the distance between the stator can 50 and the rotor 46 by relative axial displacement. For example, a differential displacement actuator 134 may be coupled between stator can 50 and a portion of collar 52 to selectively move the stator can 50 along an axial sliding bearing 136. The differential displacement actuator 134 may comprise a variety of mechanisms, such as hydraulic piston actuators, electric actuators, e.g. solenoids, or other suitable actuators which may be selectively actuated to adjust a gap 138 between rotor 46 and stator can 50. The gap or fit between the rotor 46 and the stator can 50 is affected by factors such as the mechanical tolerances of the corresponding helical surfaces 130, 132. If the surfaces 130, 132 are formed from elastomeric materials, the fit between those surfaces may be affected by any swelling or shrinkage of the elastomeric material. Additionally, the fit can be affected by chemical action, temperature changes, and/or material wear. If the fit becomes too tight, the mud motor 38 may stall and place the elastomeric material under high stress loading. If, however, the fit becomes too loose and creates inadequate sealing, the pressurized mud is prevented from efficiently energizing the rotor 46 is it flows between the rotor and the stator.

The tapered surfaces 130, 132, in cooperation with differential displacement actuator 134, enable active adjustment of this fit and optimization of mud motor operation. For example, changes in gap 138 due to wear or other factors may be compensated and/or optimization of the gap 138 may be continually adjusted during operation of the mud motor 38. Various sensors may be employed to determine an appropriate adjustment of the gap 138 by measuring parameters such as flow, torque, differential pressure, and/or other parameters. The measured parameters may then be compared with specified motor performance curves. By way of example, the comparison may be performed on a processor-based system located downhole or at a surface location to determine appropriate control signals for driving the differential displacement actuator 134 to adjust gap 138.

With a tapered stator can 50 and tapered rotor 46, the differential displacement actuator 134 also may be used to adjust the gap 138 in a matter which serves as a flow bypass. Utilization of this additional degree of control freedom enables optimization of mud motor performance in pursuit of a defined control objective. The adjustment capability afforded by the tapered components also facilitates use of metal-to-metal interaction between tapered surface 130 and tapered surface 132. The differential displacement actuator 134 enables continual adjustment of gap 138 to avoid, for example, the problem of cooperating metal components jamming due to fit and debris ingress. It should be noted that the tapered rotor 46 and the corresponding tapered stator can 50 can be used in applications in which the stator can 50 is fixed (as shown in FIG. 20) rather than being rotatably mounted as in several of the embodiments discussed above. However, the tapered rotor and stator can also may be readily interchanged with the rotors and stator cans of embodiments described above in which the stator can 50 is rotatable with respect to the surrounding collar 52.

Referring generally to FIG. 21, another embodiment of actuation control system 38 is illustrated, and the control system 38 may again be in the form of a mud motor. In this example, axial motion control is added to the mud motor system. As illustrated, the rotatable stator can 50 is coupled to device 40, e.g. a drill bit, via a drive element 140, such as a driveshaft. Additionally, the stator can 50 is able to slide axially to modulate the output force on the device/bit 42 within certain load limits and axial displacement limits defined by, for example, stops 142. The rotor 46 is rotatably and axially restrained by its flexible coupling 60 which is affixed to collar 52 by fixed structures 144 extending between flexible coupling 60 and collar 52. However, the rotor 46 is free to laterally displace within the stator can 50 as dictated by the Moineau principle. It should be noted that even with such lateral displacement, adherence to the kinematic constraints of the Moineau principle is maintained.

Rotatable and slidable motion of the stator can 50 may be controlled by a rotating axial clutch assembly 146. The clutching force of assembly 146 may be modulated by a control system 148 to achieve desired axial and torsional outputs, i.e. controlled linear or angular displacement with respect to the collar 52 or the formation; relative controlled angular or linear displacement: controlled linear force or rotational torque with respect to the collar 52 or the formation; or a desired hybrid combination of the various outputs. The control system 148 may be a processor-based control system, such as control systems described above, for carrying out various sensory and control activities related to operating the actuation control system 38.

As with several of the other embodiments described above, the axial motive force for moving stator can 50 in an axial direction can be derived from various desired sources. For example, the axial motive force may be generated by the effective pressure differential acting on either end of the stator can 50. Additionally, the axial motive force may be generated by the pressure differential between the inside and outside of the collar 52. A valve 150 may be positioned in cooperation with a port 152 through the sidewall of collar 52 to control the transition of pressure between the outside and inside regions of collar 52. By way of further example, the axial motive force may be controlled via relative motions between the rotor 46, stator can 50, and the collar 52 which are used to drive a pressure intensifier. The pressure intensifier may be in the form of a small mud motor, swash plate piston assembly, a radial cam drive piston assembly, or another suitable pressure intensifier used to generate a pressure above that of the input pressure. This increased pressure acts on an effective piston area to push or even pull the stator can 50 axially with much higher force that can be provided by the prevailing ambient differential pressures.

The rotating axial clutch assembly 146 may comprise axial and torsional clutch/motor actuators combined in one unit or separated into cooperating units positioned at, for example, opposing ends of the mud motor 38. In some embodiments, bypass valve 122 is positioned within bypass conduit/channel 120 to provide an additional measure of control over the flow and pressure dictating the axial and rotational response of the actuation control system/mud motor 38. In some embodiments, the bypass conduit 120 may be directed to the surrounding annulus. As with other embodiments described above, various sensors 154 may be employed to monitor desired parameters and to output the sensor data to control system 148, e.g. control system 44 and control module 66 illustrated in FIG. 2. Depending on the application, the sensors 154 may be designed to measure parameters such as pressure, linear and angular displacement, linear and angular velocity, force and displacement of various system components (e.g. stator can 50, rotor 46), loading on the rotor 46, stator can 50, and/or collar 52, flow velocity and other desired parameters. It should be noted that the illustrated sensors 154 and control system 148 are representative of sensors and control systems that may be utilized with the various other embodiments described herein. Furthermore, the actuation control system 38 may be designed as a low-speed motor, a high-speed motor, a two speed motor, or combination of such designs.

By utilizing the embodiment illustrated in FIG. 21 with at least a slightly tapered rotor 46 and stator can 50, the linear and/or rotational loads can be adjusted by controlling the fit between the rotor and stator can surfaces as described above with reference to FIG. 20. The direction of the taper may be designed such that shortening displacements reduce the output torque (and axial load output) of the device. In other embodiments, the direction of the taper can be reversed to produce an opposite effect in response to shortening displacements. The direction of taper depends on which concept is being considered. For example, with the wider diameter end of the taper closest to the device/bit 40, the torque output of a motor reduces if a displacement causes the stator can 50 to move backward more than the rotor 46. Conversely, for the same taper direction the fit becomes tighter if the rotor 46 moves backward farther than the stator can 50.

The efficiency of a given mud motor 38 also depends in part on the engagement length of the rotor and stator. Thus, the axial and rotational characteristics of the mud motor 38 can be adjusted by using the rotational and axial clutch assembly 146 to adjust the extent of engagement between rotor 46 and stator can 50. Additionally, passive control approaches can be used, including controlling the weight on bit from the surface and using internal springs, e.g. Belleville washers, to restrain relative motion between the rotor 46 and the stator can 50. With such passive controls, the torque and speed output of the mud motor 38 can be adjusted by using the axial loading to alter the fit between the rotor 46 and the stator can 50 in some desirable manner.

Depending on the application, the actuation control system may utilize a variety of progressive cavity systems in several configurations and arrangements. The progressive cavity systems may be used individually or in combination as Moineau style motors or pumps. In drilling applications and other downhole applications, the progressive cavity system or systems may be in the form of mud motors or mud pumps which are powered by the flow of drilling mud or by another type of actuation fluid. In many applications, the mud motors may utilize thin-walled motor technology, however a variety of stator, rotor and/or collar designs may be utilized. Additionally, various types of braking mechanisms may be constructed and arranged in several types of configurations. The braking mechanisms may be powered hydraulically, electrically, or by other suitable techniques. Additionally, various control systems, e.g. microprocessor-based control systems, may be employed to control the progressive cavity system or systems. Many types of sensors also may be employed in a variety of sensor systems to provide data to the control system regarding, for example, angular velocity and torque output. In some applications, compliance in the alignment of sets of bearings may be introduced to accommodate manufacturing and structural bending effects.

In embodiments described herein, the rotating stator can and rotor store kinetic energy because of their mass distribution and angular speeds. This energy is supplied by the drilling mud. In situations where the actuatable element 40 is a large free body connected singularly to the rotor (or the stator can), further kinetic energy can be stored in that free body in angular motion form. The spin amplification factor $z_1$ increases with the number of lobes. Thus, higher speeds and higher energy storage is obtained by increasing the lobe count. This enables the system to behave like a fluid driven inerter, and energy from the mud can be stored and released as kinetic energy. When placed in a fluid flow line subject to flow variations, the fluid driven inerter acts to smooth flow transients by switching between acting like a motor (storing energy) and a pump (releasing energy). From a flow line circuit analysis perspective, the situation is analogous to an inductor and can be used in conjunction with chokes (similar to resistors) dashpot dampers (similar to capacitors) to optimize the design of a flow circuit.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling actuation, comprising:

a collar;

a stator can rotatably mounted radially within the collar, the stator can having a stator rotational axis; and a rotor rotatably mounted radially within the stator can, the rotor having a rotor rotational axis offset from the stator rotational axis, the rotation of the rotor relative to the stator can being correlated with a volumetric displacement of fluid passing between the rotor and the stator can, the rotor being constrained against planetary movements such that the rotor rotational axis is fixed with respect to the collar during its rotation relative to the collar.

2. The system as recited in claim 1, wherein the collar is mounted in a drill string.

3. The system as recited in claim 1, further comprising an actuatable component coupled to the rotor.

4. The system as recited in claim 1, further comprising an actuatable component coupled to the stator can.

5. The system as recited in claim 1, further comprising a control system which controls the relative rotation of the stator can with respect to the collar.

6. The system as recited in claim 5, wherein the control system comprises a brake which selectively reduces slippage between the stator can and the collar.

7. The system as recited in claim 1, wherein the rotor is rotatably mounted to the collar by eccentric bearings and cooperating eccentric support elements that cooperate to offset the rotor rotational axis from the stator rotational axis.

8. The system as recited in claim 1, wherein both the rotor and the stator can rotate about their own axes without planetary motion.

9. The system as recited in claim 1, where the collar, the stator can, and the rotor are part of a mud motor.

10. A system for controlling actuation, comprising:

a collar;

a stator can;

a rotor rotatably mounted in the stator can, the rotation of the rotor relative to the stator can corresponding with a volumetric displacement of fluid passing between the rotor and the stator can; and at least one locking mechanism configured to accelerate and decelerate relative rotation between the collar and the stator can.

11. The system as recited in claim 10, further comprising at least one other locking mechanism configured to control relative rotation between the collar and the rotor, wherein the at least one locking mechanism and the at least one other locking member are configured to create a two-speed motor.

12. The system as recited in claim 10, wherein the rotor is a tapered rotor.

13. The system as recited in claim 10, wherein the rotor comprises a helical outer surface and the stator can comprises a corresponding helical inner surface.

14. The system as recited in claim 10, further comprising a controllable bypass extending to a surrounding annulus.

15. The system as recited in claim 10, wherein the rotor and the stator can are movable with respect to each other in an axial direction and in a rotational direction.

16. The system as recited in claim 10, wherein the rotor and the stator can are part of a mud motor connected into a drill string.

17. The system as recited in claim 10, wherein the at least one locking member comprises a brake.

18. The system as recited in claim 10, wherein the rotor is constrained against planetary movement such that its rotational axis is fixed with respect to the collar during its rotation relative to the collar.

19. A system for controlling actuation of a component, comprising:

a collar;

a stator can;

a rotor, the rotor being tapered and sized for receipt in a corresponding tapered region of the stator can; and an actuator positioned to adjust a gap between the rotor and the stator can, wherein the actuator is coupled between the collar and the stator can to selectively slide the stator can in an axial direction relative to the collar.

20. The system as recited in claim 19, wherein the stator can is rotationally fixed with respect to the collar.

21. The system as recited in claim 19, wherein the stator can is rotatably mounted with respect to the collar.

* * * * *